US007798735B2

(12) United States Patent
Barker

(10) Patent No.: US 7,798,735 B2
(45) Date of Patent: Sep. 21, 2010

(54) FIRE HOSE BRUSH

(76) Inventor: Calvin Barker, 5980 State Road 17, Plymouth, IN (US) 46563

( * ) Notice: Subject to any disclaimer, the term of this patent is extended or adjusted under 35 U.S.C. 154(b) by 1133 days.

(21) Appl. No.: 11/453,534

(22) Filed: Jun. 15, 2006

(65) Prior Publication Data

US 2007/0292192 A1 Dec. 20, 2007

(51) Int. Cl.
*A46B 11/00* (2006.01)

(52) U.S. Cl. ..... 401/10; 401/9; 401/291; 401/289

(58) Field of Classification Search ..... 401/9, 401/10, 11, 270, 289, 291
See application file for complete search history.

(56) References Cited

U.S. PATENT DOCUMENTS 589,559 A 9/1897 Carey
663,282 A * 12/1900 Kress ..... 68/38
1,189,505 A * 7/1916 Stockton ..... 401/10
1,332,266 A * 3/1920 McDonald ..... 401/10
3,535,047 A * 10/1970 Vireno ..... 401/10
4,502,175 A 3/1985 Hillis
5,647,084 A * 7/1997 Still et al. ..... 15/104.92

* cited by examiner

*Primary Examiner*—David J Walczak
(74) *Attorney, Agent, or Firm*—Robert L. Kelly; Dickinson Wright PLLC

(57) ABSTRACT

A hand held fire hose cleaning apparatus includes at least two brushes positioned facing each other in such a manner that a fire hose can be placed between them. Water, or another suitable fluid, is delivered through the brushes onto the site of contact between the brushes and the hose. As the fluid flows, the brushes are moved back and forth, cleaning the hose quickly and efficiently.

13 Claims, 3 Drawing Sheets

FIRE HOSE BRUSH

TECHNICAL FIELD

The present invention relates generally to brushes and particularly to a brush assembly for cleaning fire hoses.

BACKGROUND OF THE INVENTION

Fire fighting is a difficult and tiring process. In addition to the physical and mental strain inflicted upon the fire fighters, there is a heavy toll taken on the equipment they use to control and extinguish fires. Given the importance of the equipment to the safety of the firefighters, and of the public, it is important that the equipment be well maintained to ensure continued functionality.

One particularly important piece of equipment is the fire hose. After each use, the hose must be properly cleaned to ensure longevity and continued performance. Cleaning the fire hose manually requires a number of steps. Typically, one or more firefighters unroll the hose at the fire house, lay it flat on the ground and then rinse it with water. The fire fighter must then repeatedly brush the hose with a broom to remove surface contaminants, before rinsing it a second time. The hose is then flipped over and the process is repeated on the other side. For a particularly dirty hose, detergent, such as gear and hose detergent, may be used to improve the cleaning.

While there are machines for drawing a fire hose through a series of brushes, these prior art devices such as shown in U.S. Pat. No. 589,559 of Sep. 7, 1897, and U.S. Pat. No. 4,502,175 of Mar. 5, 1985, are complicated, susceptible to breakdown and maintenance issues and are often too expensive to be purchased by many fire stations, particularly volunteer fire departments which are still the first responders in many small towns and rural areas.

Thus, many fire departments must use the broom method for cleaning fire hoses, a time consuming task, and a particularly unwelcome one after hours of battling a fire.

SUMMARY OF THE INVENTION

What is needed therefore is an improved method of, and apparatus for, cleaning fire hoses which is easier, simpler, more cost effective than expensive automated machines, and faster in operation than the brooming methods currently employed.

The present disclosure describes, shows, and claims a handheld fire hose brush assembly capable of cleaning a fire hose more quickly and easily than those using known devices and methods.

A preferred fire hose brush assembly in accordance with the present disclosure comprises a body defining a brush portion with a pair of oppositely mounted brushes, a handle, and a fluid supply system. The brushes are spaced to receive a fire hose between them and are attached to the handle. The handle of the hose brush assembly can have a rubber hand grip or the handle can be made of metal and grooved to secure better gripping. The fluid supply system includes a fluid channel in the body which distributes fluid to the brushes.

In a preferred embodiment, the oppositely mounted brushes are spaced, and are of sufficient length, such that they accept any standard fire hose, including 1.75" hoses and 2.5" hoses.

In another embodiment, the brush assembly is adapted to include a detergent reservoir in communication with the fluid path, thereby allowing detergent to be applied to the hose to aid in cleaning.

A method of cleaning a hose in accordance with the present invention resides in placing the hose within a brush assembly that comprises a body having internal fluid passages and oppositely mounted brushes arranged to embrace the hose, delivering fluid into at least one of the brushes via said internal fluid passages and moving the brushes along the length of the hose. The fluid can include water or water mixed with detergent.

These and other objects, features and advantages of the invention will be more fully explained in connection with the detailed description of the preferred embodiments and in connection with reference to the accompanying drawings.

BRIEF DESCRIPTION OF THE DRAWINGS

Referring now to the drawings where preferred embodiments of the present invention are shown in detail, it being understood that although the drawings represent certain preferred embodiments of the present disclosure, the drawings are not necessarily to scale and certain features may be exaggerated to better illustrate and explain the present disclosure. The embodiments shown herein are not intended to be exhaustive or to otherwise limit the disclosure.

DESCRIPTION OF PREFERRED EMBODIMENTS

Figure 1:
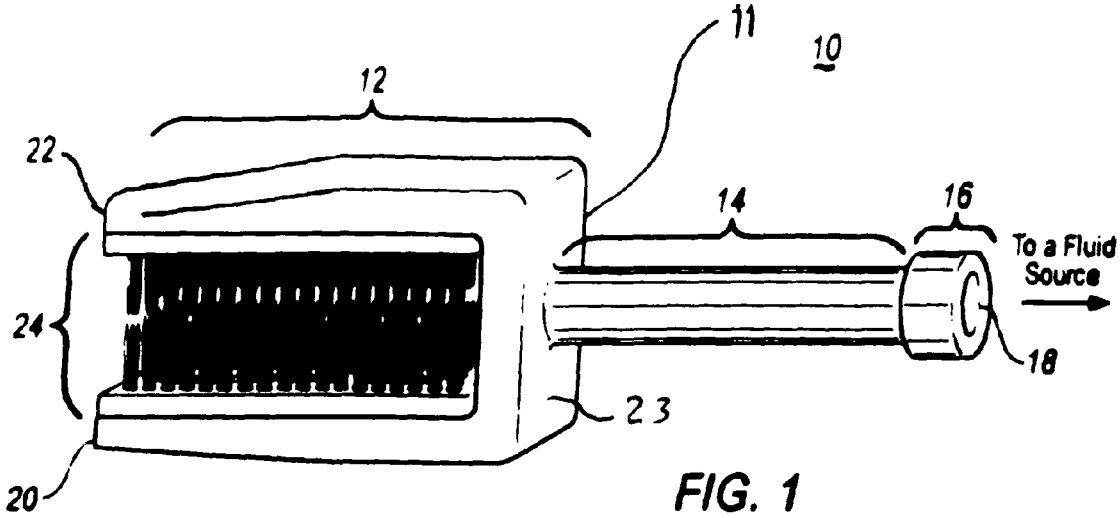
FIG. 1 illustrates a perspective view of a fire hose brush assembly according to the present disclosure.
Figure 2:
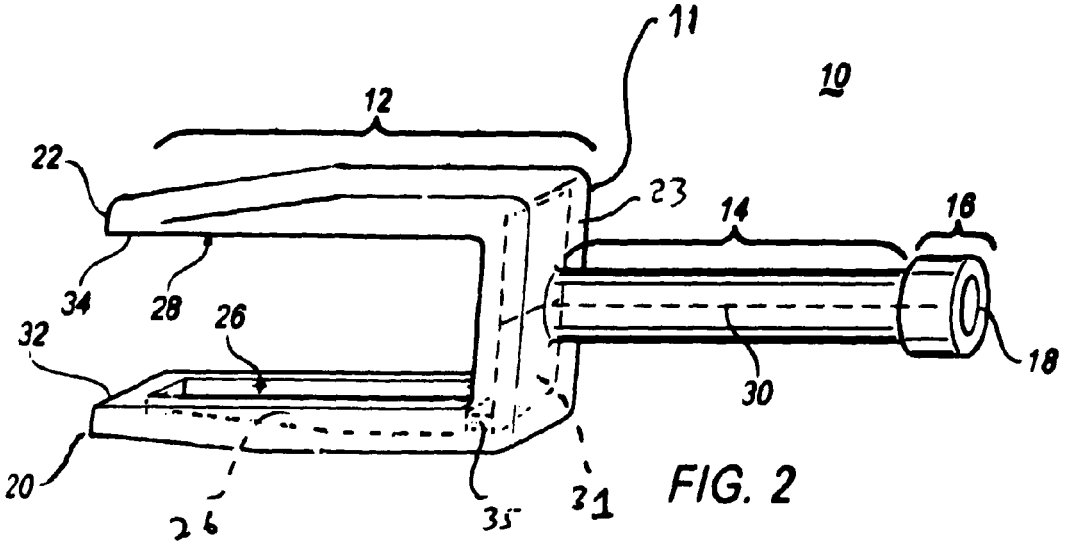
FIG. 2 is a view of the fire hose brush assembly according to the present invention where the brushes are removed to illustrate water pockets.

Referring now to FIGS. 1 and 2 of the drawings, a hose brush assembly 10 shown in accordance with the present invention has body 11 which comprises brush portion 12 and handle 14. In a most preferred embodiment, brush section 12 and handle 14 are an integral unit (i.e., body 11 is preferably a single piece casting of aluminum), although it may be possible to make a handle 14 which threads into brush portion 12 or the like. The end of handle 14 opposite brush portion 12 includes internally threaded inlet 16 defining aperture 18 which is adapted to receive fluid from a fluid source (shown as hose 54 in FIG. 8), which may be a water hose connected to a fire truck. Inlet 16 may have internal and/or external threads (not shown) or other attachment means. Brush portion 12 is generally U-shaped with two arms 20 and 22 and crossbar 23. Brushes 24 are oppositely mounted within arms 20 and 22 at fluid pockets 26 and 28. When assembly 10 is connected to the fluid source, fluid flows into aperture 18 into fluid channel 30 defined through the handle 14 and continues to at least one arm, but preferably into both arms 20 and 22 of brush portion 12 as will be more fully described. Fluid then exits into fluid pockets (cavities) 26 and 28 (one being shown in phantom in FIG. 2 for simplicity) defined in each of arms 20 and 22, via passages 35 and outlets 39 to and through holes 33 (FIG. 3) defined in base 38 of brushes 24. The spacing between and length of brushes 24 allows them to be used to clean hoses of multiple traditional sizes, specifically, widely used 1.75" hoses and 2.5" hoses.

Figure 3:
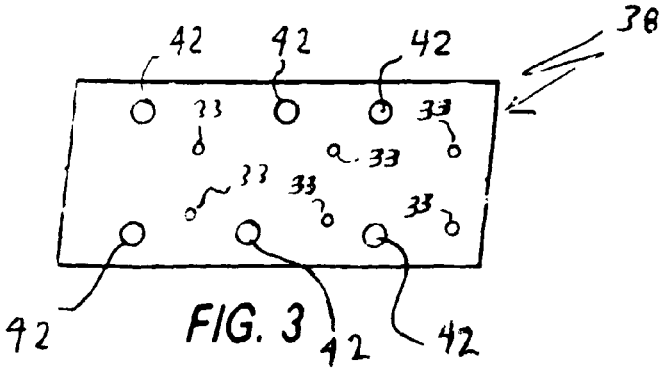
FIG. 3 is a view of the underside of one brush.
Figure 3A:
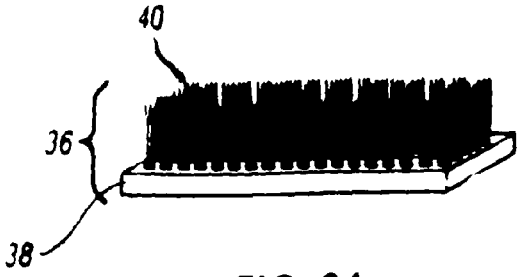
FIG. 3A is a perspective view of the brush.
Figure 3B:
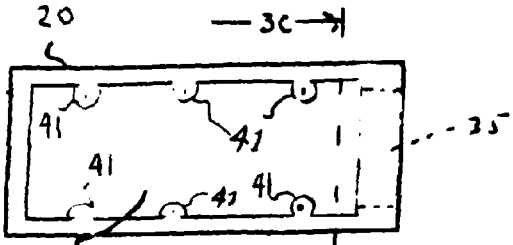
FIG. 3B is a top view of the cavity which the brush is mounted.
Figure 6:
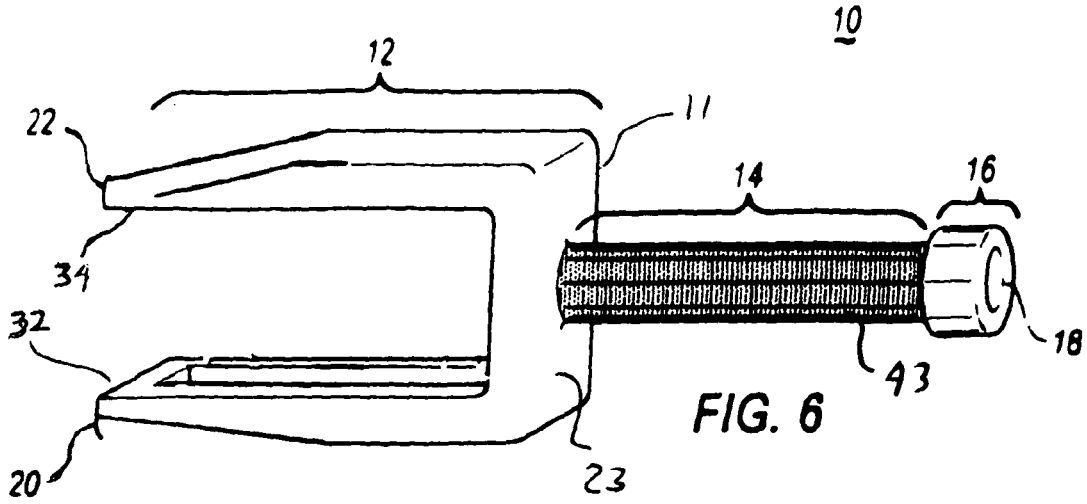
FIG. 6 shows the brush assembly with a rubber handle grip attached.
Figure 7:
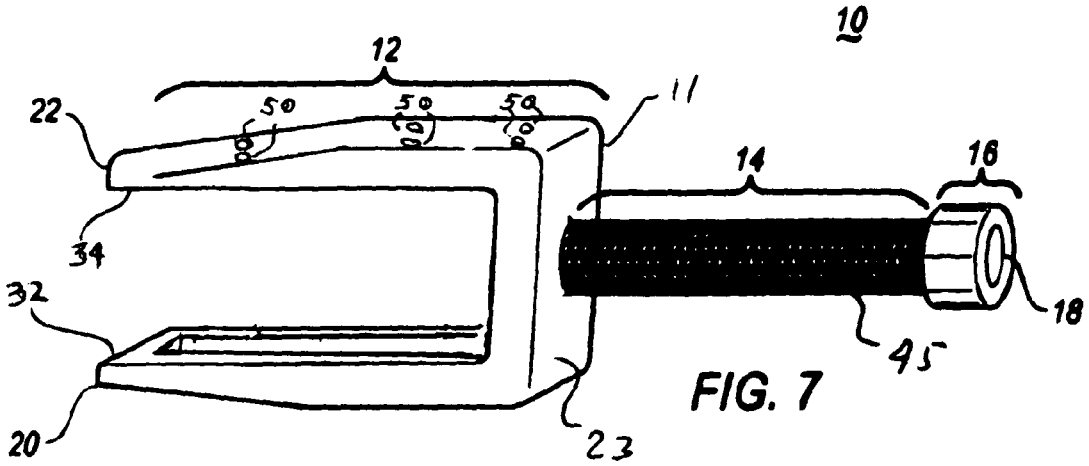
FIG. 7 illustrates the brush assembly with a metal handle provided with knurling.

Turning now to FIGS. 2 and 3B, hose brush assembly 10 is shown without brushes 24 to illustrate fluid pockets 26 and 28 disposed within arms 20 and 22 of brush portion 12. It is to be understood, then, that internal fluid channel 30 runs from aperture 18, through handle 14, to manifold 31 in crossbar 23 and then splits to provide fluid through passages 35 (one shown in phantom for simplicity) to pockets 26 and 28. Body 11 is preferably made of aluminum or can be made of hard rubber, plastic or another metal. Optionally, a removable rubber or plastic hand grip 43 can also be slipped over handle 14 as shown in FIG. 6. Knurling 45 can be cut onto a surface of the handle to make hand grip more reliable, as shown in FIG. 7. Fluid manifold 31 is in fluid communication at the fluid pockets 26 and 28 via channels 35. The fluid thereby exits the brush portion 12 from fluid pockets 26 and 28, typically through holes 33 (FIG. 3) in brushes 24 mounted thereon. As shown in phantom in FIG. 2, cavity 26 is deeper at the end closest to passage 35 and thus holds a greater volume of water than the opposite end of cavity 26. Alternatively, cavity 26 may be of uniform depth.

As stated, brush portion 12 comprises a U-shaped assembly having first arm 20 and second arm 22. First face 32 on first arm 20 opposes second face 34 on second arm 22. First fluid pocket 26 and second fluid pocket 28 (not visible) are in fluid communication with fluid channel 30 as follows. Water, or other suitable fluid, flows through inlet aperture 18, through handle 14 to manifold 31 and then through channels 35 and outlets 39. The fluid then exits from fluid pockets 26, 28 to brushes 24. A first brush 36 (FIG. 3A) and a second brush are attached to the brush portion 12 atop first fluid pocket 26 and second fluid pocket 28, such that fluid exits the fluid pockets 26, 28 through holes 33 (FIG. 3) in a respective brush. This allows the fluid to be delivered to the fire hose directly at the brush portion (via the fluid delivery channels) facilitating the cleaning process.

Figure 3C:
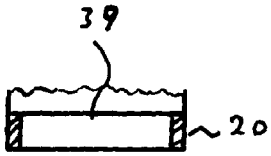
FIG. 3C is a cross-section taken along lines 3C of FIG. 3B.
Figure 5A:
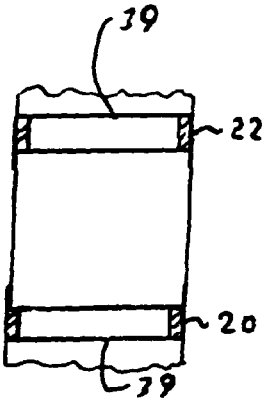
FIG. 5A is a cross-section taken along lines 5A of FIG. 5.

Referring now to FIG. 2, only pocket 26 is shown (partially in phantom) as well as channel 35 (in phantom) in arm 20 for simplicity. It is to be understood that in the preferred embodiment, this same structure is present in arm 22. In FIGS. 3B and 3C, outlets 39 of passages 35 are shown as rectangular in shape (e.g., 2½"×½") which, in operation, continuously fill pockets 26 and 28 with fluid which then flows through holes 33 which extend through brush base 38 to bristles 40. With reference to FIGS. 5A and 3C, outlets 39 of passages 35 are shown in arms 20 and 22. Thus, it will be understood that body 11 has an internal fluid passageway from inlet 18 to outlets 39 via manifold 31 and passages 35.

Referring now to FIG. 3A, brush 36 is shown in accordance with the present invention. The brush 36 includes base 38 with a plurality of bristles 40 arranged thereon. Base 38 is shown from the side opposite bristles 40 in FIG. 3 having holes 42 which accept screws or other types of fasteners. Two brushes 36 are mounted to the brush portion 12. Base 38 includes at least one hole 33 therein, arranged such that fluid can travel from the pockets 26 and 28, through holes 33 in base 38 and into bristles 40 to aid in cleaning. Brush 36 can be attached to the brush portion 12 in any conventional manner as will be explained more fully.

Again, FIG. 3 is a bottom view of brush 36, in which base 38 is shown along with a plurality of holes 33 to let liquid flow through base 38 and onto the hose to be cleaned. Attachment holes 42 are also seen which receive fasteners, such as screws, bolts, rivets and the like that extend through to be secured in bosses 41 (FIG. 3B). Screws 50 (FIG. 7) are preferred since they allow worn brushes to be easily replaced. In the preferred embodiment at least six screws are used with six corresponding pads or bosses 41. Base 38 may be made of a variety of materials; presently preferred are moldable plastics which cure or harden with minimum flexibility (i.e., rigid).

Figure 4:
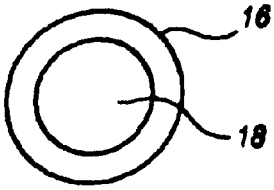
FIG. 4 is a view of an inlet and aperture in the handle of the fire hose brush assembly.
Figure 5:
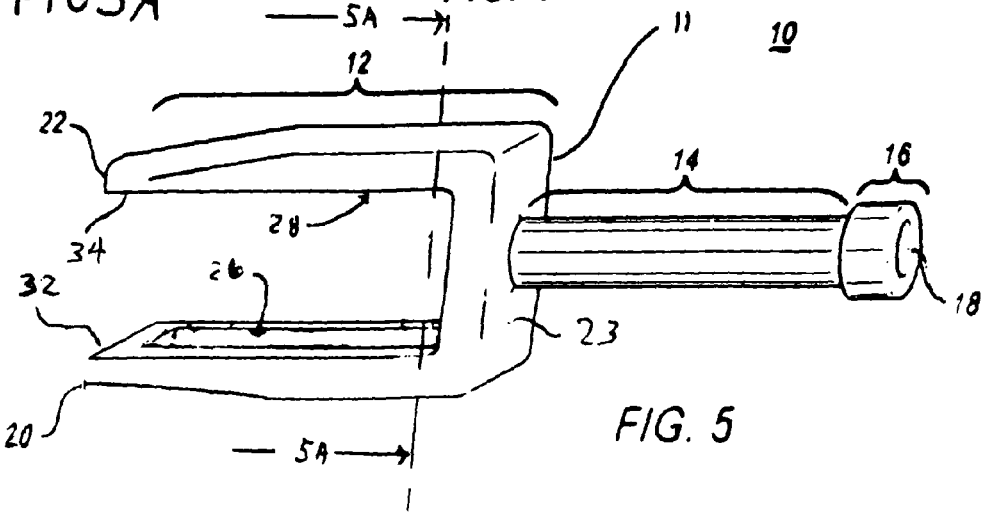
FIG. 5 is another view of the fire hose brush assembly with the brushes removed.

As best seen in FIGS. 4 and 5, inlet 16 has aperture 18 which is adapted to receive a fitting from hose 54 (FIG. 8) to connect, for example, to a fire truck. Hose 54 provides a quantity of pressurized water, which is then used to clean the fire hose. By using such an embodiment, a fire hose can easily be cleaned anywhere it is used, including the site of a fire as the hoses are being collected. This would eliminate the need to unravel and clean the hoses later at the fire station, saving considerable time and effort for the firefighters. (It is to be understood that FIG. 5 shows body 11 without brushes 36 over cavities 26 and 28.)

Figure 8:
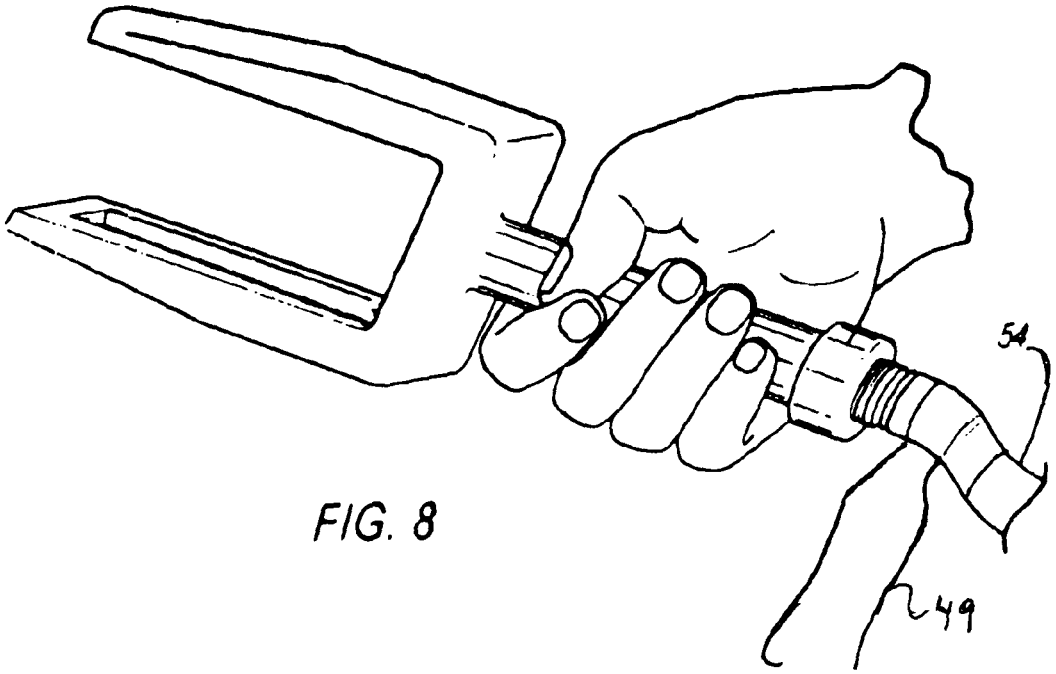
FIG. 8 shows a user's hand grasping the fire hose brush assembly attached to a threaded hose to supply water with a detergent uptake reservoir.

FIGS. 6-8 illustrate fire hose brush assembly 10 according to the present invention, in which handle 14 is made more amenable to grip by hand. In FIG. 7, handle 14 has removable rubber or plastic hand grip 43 attached thereto. In FIG. 7, handle 14 is provided with knurling 45 to make a secure handgrip. FIG. 8 shows assembly 10 in a user's hand and connected to hose 54. As shown in FIG. 8, a soap container 49 may be attached to supply soap to the water stream by the venturi effect.

In the method of the present invention, using assembly 10, a flattened fire hose is positioned within opposing brushes 24. As fluid flows through the brushes, the brush assembly is moved along the length of the hose, thereby cleaning both sides of the hose at the same time. The fire hose is thus cleaned in an easy motion. Depending on the availability of a fluid source, this can be accomplished at the scene of a fire, as the fire fighters are cleaning up the equipment.

It is to be understood that the above description is intended to be illustrative and not limiting. Many embodiments will be apparent to those of skill in the art upon reading the above description. Therefore, the scope of the invention should be determined, not with reference to the above description, but instead with reference to the appended claims, along with the full scope of equivalents to which such claims are entitled.

What is claimed is:

1. A hand held fire hose cleaning assembly consisting essentially of:

a one-piece non-hinged body, said body having a handle to be grasped by a user's hand, a pair of arms spaced from one another, and an internal passageway extending from said handle to said arms and through which water is adapted to flow;

said internal fluid passageway extending from a fluid inlet at an end of said handle opposite said arms to a fluid outlet at said arms;

said arms being spaced from one another by a length allowing placement of a fire hose having a 1.75 inch to 2.5 inch diameter therebetween;

a pair of brushes having bristles opposing one another and each attached to one of said arms for embracing the fire hose;

each of said brushes having a base attached to said arm and defining a plurality of perforations in fluid communication with said fluid outlet for delivering water into said bristles;

said base defining a plurality of attachment holes; and an attachment means for extending through said attachment holes and removably mounting said brush bases on said arms.

2. The hand held hose cleaning assembly of claim 1 wherein said fluid inlet is adapted to receive a fitting from a water hose providing water to said internal fluid passage.

3. The hand held hose cleaning assembly of claim 1 further including a detergent reservoir adapted to provide a quantity of detergent to the water flowing through said internal fluid passage and into said bristles, to further aid in cleaning.

4. A fire hose cleaning assembly, consisting essentially of:

a body having a pair of arms spaced from one another by a crossbar;

said arms extending parallel to one another and spaced from one another by a length allowing placement of a fire hose having a 1.75 inch to 2.5 inch diameter therebetween;

each of said arms defining a fluid pocket facing inwardly and opposing the other fluid pocket;

said body including a handle extending transversely from said crossbar;

said handle being disposed an equal distance from each of said arms;

said body having an internal fluid passageway extending from a fluid inlet at an end of said handle opposite said arms to a fluid outlet at said fluid pocket through which water is adapted to flow;

a pair of brushes opposing one another and each attached to one of said arms at said fluid pocket for embracing a fire hose;

each of said brushes having a base and bristles extending upwardly from said base;

said base being attached to said arm at said fluid pocket and defining a plurality of perforations therein through which water from said fluid pocket flows to said bristles;

said base of said brush defining a plurality of attachment holes for attaching said base to said arms; and an attachment means extending through said attachment holes and removably mounting said base on said arms at said fluid pocket.

5. The hand held fire hose assembly of claim 4 wherein said arms and said handle extend parallel to one another.

6. The hand held fire hose assembly of claim 4 wherein said arms include a plurality of bosses at said fluid pockets for securing said attachment means therein.

7. A method of cleaning a hose consisting essentially of the steps of:

holding in one's hand a one-piece body with oppositely mounted brushes, said brushes having bases with perforations for the flow of water from a water source and holes to removably mount said brushes on said body;

placing said hose between said oppositely mounted brushes;

delivering water into said brushes through a water passageway in said body; and causing relative movement between said brushes and said hose.

8. The method of claim 7, wherein said fluid further includes detergent.

9. The hand held fire hose cleaning assembly of claim 1, wherein said body is formed of metal or plastic.

10. The hand held fire hose cleaning assembly of claim 1, wherein said body is made of aluminum.

11. The hand held fire hose assembly of claim 1, wherein said end of said handle defines an aperture and wherein a detergent reservoir is attached to said end of said handle.

12. The hand held fire hose assembly of claim 1, wherein said arms are spaced from one another by a crossbar and said handle extends transversely from said crossbar.

13. The hand held fire hose assembly of claim 12 wherein said arms and said handle extend parallel to one another.

* * * * *